United States Patent [19]

Mairs, III et al.

[11] Patent Number: 4,599,754

[45] Date of Patent: Jul. 15, 1986

[54] COMBINATION WIND SCREEN AND BEACH BLANKET APPARATUS

[76] Inventors: Robert W. Mairs, III; Darra A. Mairs, both of 149 Marina Dr., Edison, N.J. 08817

[21] Appl. No.: 658,635

[22] Filed: Oct. 9, 1984

[51] Int. Cl.[4] ..... A45F 1/14; A47G 9/00

[52] U.S. Cl. ..... 5/418; 5/512; 135/96; 428/131

[58] Field of Search ..... 428/919, 81, 131; D21/253; 5/418, 419, 512; 135/90, 96

[56] References Cited

U.S. PATENT DOCUMENTS

| | | | |
|---|---|---|---|
| 1,344,588 | 6/1920 | Kozik | 5/512 |
| 1,827,477 | 10/1931 | Kotavsek | 5/418 |
| 2,155,330 | 4/1939 | Pottenger | 135/96 X |
| 2,190,566 | 2/1940 | Julian | 5/418 X |
| 2,264,471 | 12/1941 | Glenn | 5/419 |
| 2,898,609 | 8/1959 | Storie | 5/419 |
| 2,907,057 | 10/1959 | Specht | 5/417 |
| 3,237,904 | 3/1966 | Abruzes | 248/508 |
| 3,442,275 | 5/1969 | Ternes | 428/919 X |
| 3,769,747 | 11/1973 | Chapman, Jr. | 428/121 X |
| 3,863,387 | 2/1975 | Webster et al. | 5/420 X |
| 4,100,633 | 7/1978 | Pintos | 5/418 |
| 4,364,193 | 12/1982 | Visco | 428/919 X |
| 4,473,087 | 9/1984 | Cavender | 428/919 X |

FOREIGN PATENT DOCUMENTS

| | | | |
|---|---|---|---|
| 1562638 | 3/1980 | United Kingdom | 428/192 |

*Primary Examiner*—Henry F. Epstein
*Attorney, Agent, or Firm*—Arthur L. Plevy

[57] ABSTRACT

A combination wind or sun screen and beach blanket apparatus includes a blanket having at least one aperture in each corner. A screen assembly consists of right and left poles having disposed between them a flexible sheet of material, the poles have tapered or pointed ends for insertion into the corner aperture of the blanket to secure the blanket in the ground and to form a vertical wall to block the effect of the wind or to operate to cast a shadow on the blanket as desired.

10 Claims, 2 Drawing Figures

COMBINATION WIND SCREEN AND BEACH BLANKET APPARATUS

BACKGROUND OF THE INVENTION

This invention relates to a combination beach blanket and wind or sun screen apparatus and more particularly to such apparatus which is easy to transport and deploy.

The use of beach blankets for lying on the beach and elsewhere present typical problems which are familar to all. Hence, the blankets must be properly secured, and therefore, users place heavy objects such as shoes etc. at the corners. In any event, the blankets during typical use roll up and difficulty is incurred in maintaining a desirable orientation. Apart from such considerations, weather conditions such as wind, sun position and so on typically present problems to beach goers. Under windy conditions sand is blown over the user and the blanket and protection from the sun during the course of a day might also present problems. Hence many supplemental devices such as umbrellas, canopies and so on are also employed at the beach in consideration of said problems.

The prior art is fully aware of the conditions and various patents have issued which attempt to mitigate such problems and other problems as well.

U.S. Pat. No. 1,827,477 entitled REPOSING MAT WITH FOLDABLE SUN BLIND issued on Oct. 13, 1931 to J. Kotausek. This patent describes a combination mat with an integral foldable sun blind. The unit contains adjustable frames so one can adjust the integral blind in regard to the orientation of the sun or wind.

U.S. Pat. No. 2,264,471 entitled BEACH BLANKET issued on Dec. 2, 1941 to C. R. Glenn. This patent shows a combination beach blanket which includes pockets or compartments to hold various items and includes a waterproof base layer which is snapped together by means of snap fasteners.

U.S. Pat. No. 2,898,609 entitled BEACH PACK issued on Aug. 11, 1959 ... to J. Storie. This patent shows a beach pack which can be unfolded into a blanket which also contains pockets for the storage of pillows or other items. The blankets has grommet holes through which pegs are inserted to secure the blanket in place. Other patents as U.S. Pat. No. 2,190,566 entitled BEACH ACCESSORY by C. E. Talian issued on Feb. 1, 1940, and U.S. Pat. No. 4,100,633 entitled COMBINATION SUN SCREEN AND PILLOW by J. L. Pintos issued on July 18, 1978 show other apparatus for use at the beach employing adjustable sun screens and similar apparatus.

As one can ascertain these devices are relatively complicated and are difficult to use as well as expensive to make. The devices have certain disadvantages as not considering a host of problems attendent with the environment at the beach.

It is, therefore, an object of the present invention to provide a combination beach blanket and screen assembly which functions as an assembly to provide the dual purposes of firmly securing a blanket while providing a shield against wind and sun having the capability of storing articles as well.

BRIEF DESCRIPTION OF THE PREFERRED EMBODIMENT

The combination of a screen and blanket apparatus comprising a blanket having located on the surface thereof in each corner an aperture of a given dimension, a screen assembly having a right and left pole with each of said poles having pointed ends for insertion into corner apertures of said blanket and having a flexible screen sheet assembly secured to said poles to form a relatively vertical wall when said ends of said poles are inserted into said apertures at opposing corners of said blanket.

DETAILED DESCRIPTION OF THE FIGURES

Figure 1:
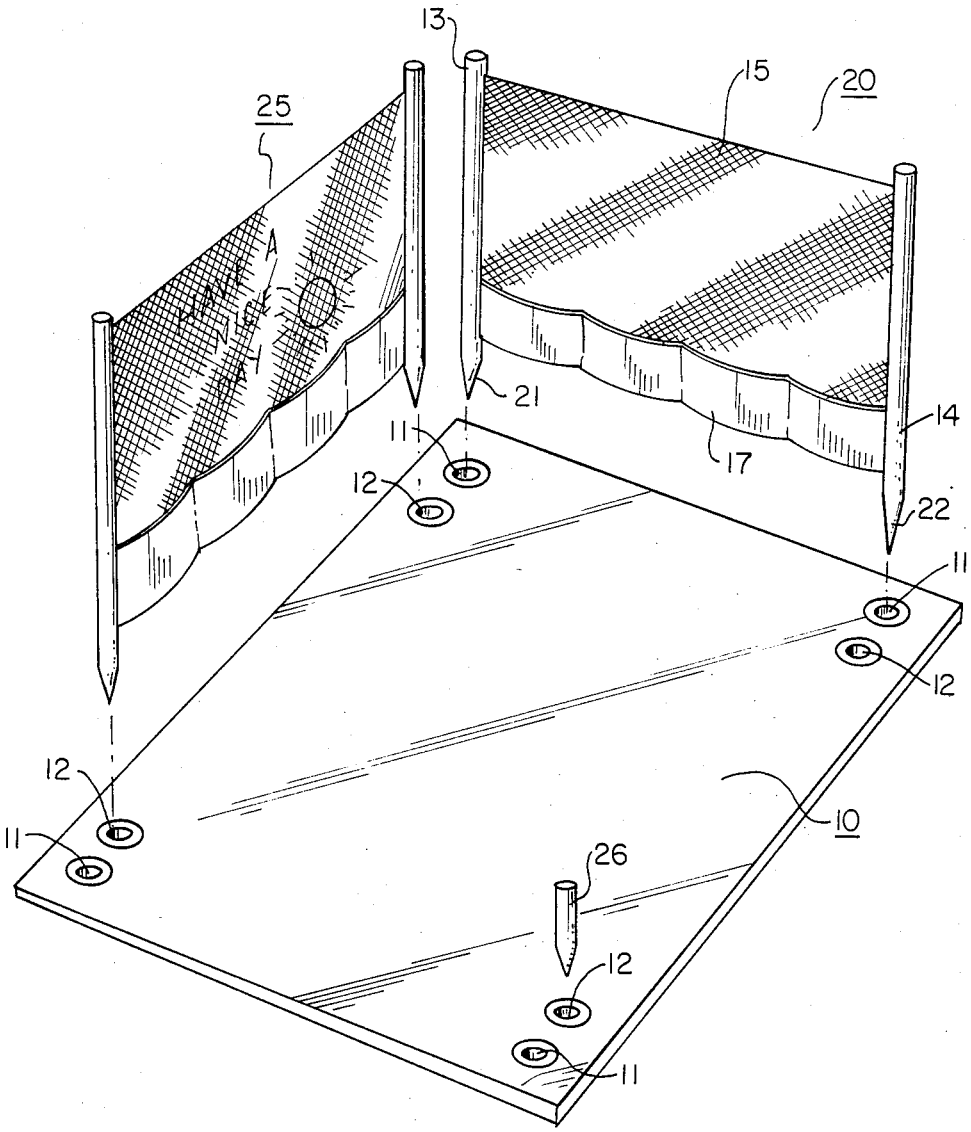
FIG. 1 is a perspective plan view of a combination blanket and screen assembly according to this invention.

FIG. 1 shows a beach blanket 10 which is relatively a standard type of blanket and may be fabricated from various materials such as synthetic fiber, wool and so on. The blanket 10 has a series of eyelets as 11 at each corner with further eyelets 12 adjacent each eyelet 11. The eyelets as 11 and 12 are essentially apertures formed in the blanket 10 at the corners and are associated with a peripheral noncorrosive ring to provide structural rigidity.

The blanket 10 is anchored or otherwise secured in the sand by means of a screen assembly 20, which essentially consists of a right and left pole or post 13 and 14 having tapered ends 21 and 22 for insertion in the eyelets to secure the blanket 10 in position. Located between and secured to the posts 13 and 14 is a canvas or flexible screen or sheet 15. The screen 15 may be fabricated from a host of various materials and secured to the posts 13 and 14 by conventional means. Positioned on the bottom of the screen assembly 15 are a plurality of pockets or compartments 17 to enable the user to store various items as suntan oil, wallet, watch and so on. As seen from FIG. 1, the screen assembly 20 is positioned so that the posts 13 and 14 are inserted with the corner eyelets 11 to secure the blanket. The screen forms a vertical wall for protecting the user against the wind or sun according to conditions.

Another screen assembly 25 of identical configuration can be positioned between eyelets 12 and hence the assemblies 21 and 25 form an L-shaped configuration with respect to the blanket. The other corners of the blanket are held in place by pegs as 26 to firmly secure the blanket in position.

Figure 2:
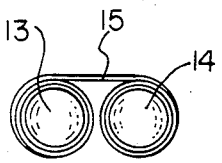
FIG. 2 is a front end view of a screen assembly in a transportable orientation.

As is known, the screen sections 15 may be colored for aesthetic purposes or may contain advertising material on the outer surfaces. In this manner the user is provided with a blanket 10 which is secured in position by means of the screen assemblies 20 and 25, which assemblies provide protection from the wind or from the sun. The screen sections 20 and 25 can be moved according to the desires of the user during the course of the day depending on changing wind or sun positions. The height of the screens may be between 2 to 6 feet or any convenient dimension to provide protection. Essentially, the entire unit is easily transported as the screen can be rolled about the poles as 13 and 14 for storage and transport as shown in FIG. 2.

While the use of two screen assemblies as 20 and 25 is probably preferable, it is understood that one or more than two such assemblies may be employed. It is further apparent that the apparatus shown, while being simple to use and construct, maintains a minimum of space and actually the user of such apparatus requires the same beach space as the user of a conventional blanket. The screen assemblies 20 and 25 as indicated are decorative and can contain advertising or other graphics to present an extremely aesthetic assembly with the attendant functional advantages.

It is also apparent that the blanket 10 may be rectangular or square or of any convenient shape as can be the screen assemblies. The pocket number 17 can also be fabricated to include flaps for protection or zippers or other closures for further security and protection of articles.

Thus many alternate configurations will be discerned from reading the above specification and all such modifications are deemed to be encompassed within the scope and breadth of the claims appended hereto.

We claim:

1. The combination of a screen and blanket apparatus comprising:

a blanket having located on the surface thereof and in each corner an aperture of a given dimension, a screen assembly having a right and left pole with each of said poles having pointed ends for insertion into corner apertures of said blanket, and having a flexible screen sheet assembly secured to said poles to form a relatively vertical wall when said ends of said poles are inserted into said apertures at opposing corners of said blanket.

2. The combination according to claim 1 wherein said screen assembly has a plurality of pockets formed on a surface thereof to hold various items.

3. The combination according to claim 1 wherein said blanket has two apertures in each corner.

4. The combination according to claim 3 further including a second screen assembly generally of the same configuration as the first having left and right poles for insertion into said other apertures in said corners to form L-shaped vertical walls with respect to said blanket.

5. The combination according to claim 1 further including at least one peg assembly located in one of said apertures of said blanket to assist said screen assembly in firmly securing said blanket.

6. The combination according to claim 1 wherein said apertures include supporting rings surrounding the periphery of said apertures.

7. The combination according to claim 1 where said screen sheet contains graphic information on a surface thereof.

8. The combination according to claim 1 wherein said screen sheet is fabricated from a canvas material.

9. The combination according to claim 1 wherein said blanket is rectangular in configuration.

10. The combination according to claim 1 wherein said screen assembly is between 2 to 6 feet in height.

* * * * *